US008739708B2

(12) United States Patent
Rabiner

(10) Patent No.: US 8,739,708 B2
(45) Date of Patent: Jun. 3, 2014

(54) METHOD AND PLANT FOR PROCESSING CONTAMINATED WASTE

(76) Inventor: Yuriy Rabiner, New York, NY (US)

( * ) Notice: Subject to any disclaimer, the term of this patent is extended or adjusted under 35 U.S.C. 154(b) by 194 days.

(21) Appl. No.: 13/173,237

(22) Filed: Jun. 30, 2011

(65) Prior Publication Data

US 2013/0000532 A1 Jan. 3, 2013

(51) Int. Cl.
*F23G 7/00* (2006.01)

(52) U.S. Cl.
USPC ..... 110/341

(58) Field of Classification Search
USPC ..... 110/218, 219, 220, 221, 224, 229, 232, 110/233, 346, 347, 204, 210, 215, 216, 237
See application file for complete search history.

(56) References Cited

U.S. PATENT DOCUMENTS

| | | | | |
|---|---|---|---|---|
| 5,139,203 | A | 8/1992 | Alavi | |
| 5,547,134 | A * | 8/1996 | Rubenstein | 241/24.14 |
| 5,683,040 | A * | 11/1997 | Jakob et al. | 241/24.14 |
| 6,178,899 | B1 * | 1/2001 | Kaneko et al. | 110/346 |
| 6,202,577 | B1 * | 3/2001 | Boguslavsky et al. | 110/346 |
| 7,407,122 | B2 | 8/2008 | Madar | |
| 7,611,576 | B2 * | 11/2009 | Rabiner | 106/745 |

FOREIGN PATENT DOCUMENTS

| | | | | |
|---|---|---|---|---|
| JP | 06226242 | A * | 8/1994 | B09B 5/00 |
| RU | 2068010 | | 10/1996 | |
| RU | 2166376 | | 5/2001 | |

OTHER PUBLICATIONS

Complete Installation and Technological Line for Waste.
Computer Landfills Pollute Asia; http://news.bbc.co.uk.
Computer will Recycle; http://www.mtspb.com; http://www.strf.fu.
Current Status of Extraction of Metals from Scrap Radio Boards and Products of their cut; www.nbuv.gov.ua.
Cyclonic Jet Mill.
Environmental and Economic aspects of Recycling Zoloshlakov TPP; http://masters.donntu.edu.ua; Tselykovsky.

(Continued)

*Primary Examiner* — Kenneth Rinehart
*Assistant Examiner* — Tavia Sullens
(74) *Attorney, Agent, or Firm* — Lucas & Mercanti, LLP; Jonathan Myers

(57) ABSTRACT

A municipal or like refuse is crushing, separating ferrous metals, mixing with crushed limestone, drying up and loading in furnace of pyrolysis. An electronic and electric scrap is crushing, drying up from surface water and warming on 2-4° C. above temperature of transporting air, divide into concoction nonferrous and precious metals and dielectric fraction, which go in furnace of pyrolysis by specified air, cleaned from dust and moistened up to 100% moisture by water. At mixing with dielectric fraction temperature of the air increases, relative moisture falls down to level, excluding condensation of moisture and spark formation in system. Pyrolysis is carried out under simultaneous neutralization fo allocated hydrogen chloride by limestone with reception of calcium chloride. Gas allocated at pyrolysis condensing and dividing to water and organic phases (liquid fuel). Solid products of pyrolysis together with ash and slag supplied from heaps of waste generated by a heat power station, washing by specified water phase for dissolving of calcium chloride and extracting ions of heavy metals, then centrifuging. Filtrate and washing water cleanse from heavy metals. Solid products of pyrolysis move for incineration in combustion chamber. Combustion chamber slag, cleanse from heavy metals and not burned-out fuel in slag of heat power station, cool by air, which is then used in combustion chamber. Slag concrete products expose by the thermohumid processing by part of humid chimney gases after drying the calcium chloride, the other part gas is going to production of the carbonic acid.

9 Claims, 1 Drawing Sheet

(56) References Cited

OTHER PUBLICATIONS

E-waste threatens the world; www.solidwaste.ru.
Guiyang—the city of miners from e-waste; http://www.ot.rusk.ru.
IMM technology against waste; No. 12, 2001, p. 29-35; Knatko.
Implementation of fly ash and zoloshlakov.
National Geographic—E-waste.
NEC launches the "Ecoseparation system"; Newsbytes Nov. 28, 2002.
Processing zoloshlakov TPP; The European Association of Combustion and Coal; http://ccp.e-apbe.ru.
Static electricity; http://na5.ru.
The new gel is making gold with newspapers; http://www.membrana.ru.
UN experts have adopted a set of technical guidelines on recycling mobile phones.
The effect of "lipnuschego dress" turns Cinderella into a princess; Mar. 2002; www.mobiset.ru; www.dpgazeta.ru.
Cleanse the world of computers; http://gov.cap.ru.
Calcium silicate bricks, ceramics and fused materials based on slags and ashes TPP; http://bibliotekar.ru.
Classification of powders to produce the required quantity and quality of product fractions.

* cited by examiner

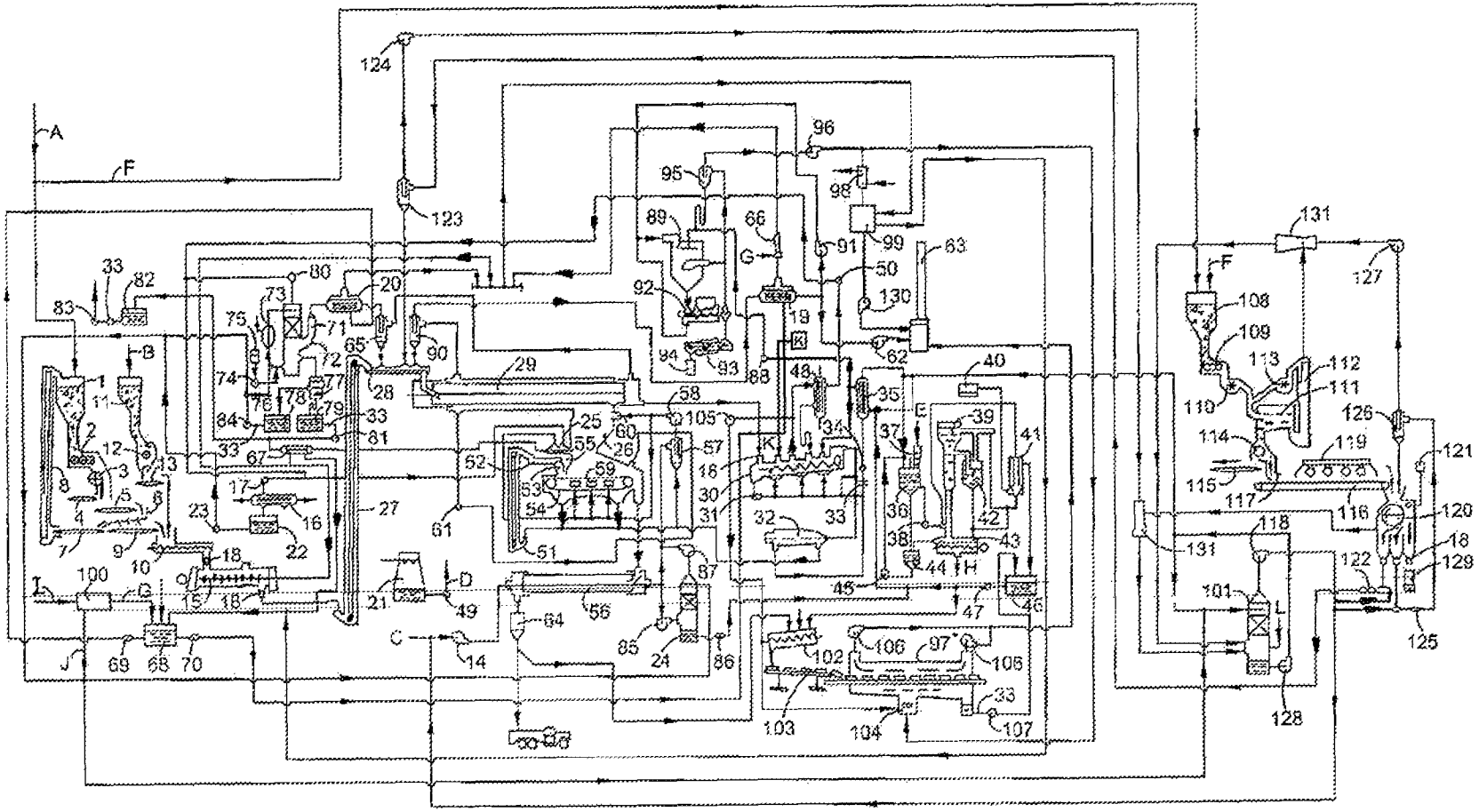

METHOD AND PLANT FOR PROCESSING CONTAMINATED WASTE

FIELD OF THE INVENTION

The present invention relates a method and a plant for processing waste, including solid municipal or like refuse and for processing the refuse together with ash and slag of heat power station and boiler plants, electronic, electric and cable scrap, oil-industry wastes (oil sludge, acid tars, etc.), soil polluted by pesticides and oil products, used tires, all kinds of plastics, sewage sludge from city waste water treatment plants, the polluted ground sediment of reservoirs, biologically polluted waste products of hospitals, the contents of animal burial, landfills, etc.

BACKGROUND OF THE INVENTION

All over the world the ash and slag of heat power stations are stored in heaps, that turns significant areas of the land to wasteland. As a result of dust formation and burning of heaps of the wastes, the adjoining terrain and air are polluted. Using a hydraulic method for removing the ash and slag (this method remains dominant at modern heat power station) requires significant water consumption. Water after contact with ash has a pH above 10, and contains fluorine, arsenic and vanadium in concentrations, exceeding tolerance. (Vetoshkin A. G. The Protection of the Lithosphere from Contamination. Penza University, 2005). At the present time varied attempts are undertaken to use the slag and ash of heat power stations, working at coal, schist, fuel oil, etc. Slag and ash are used to make curb stones, barrier reefs and blocks for construction, are added to asphalt and are used for other road coverings, as well as additives in the cement industry (Levandovskiy W, Foerborn H. Processing Zoloshlakov TPP. Processing Plant Fly Ash in Europe. The European Association of Combustion of Coal. /ccp.e-apbe.ru/uploads/files/ecoba.pdf). But slags and ash are toxic, their toxicity based on toxicity of incorporated heavy metals. The concentration of oxides of heavy metals in slag and ash is 2-3 times (and sometimes more) higher than the concentration in burnt solid waste or coil, moreover, significant amount of heavy metals are in fly ash: arsenic, barium, beryllium, cadmium, chromium, cobalt, copper, lead, quicksilver, strontium, vanadium, zinc and etc. The toxic heavy metals are released in stable form—the salts or oxides and can remain in the ash for an indeterminate number of years. When heavy metals enter the human body, they lead to different heavy metal diseases. (Yufit S. S. Incinerate Factories—Rubbish Heap in the Sky. Ekoline, 1998).

Very often the determinative parameter in the delivery of ash and slag materials to the consumer is mechanical fuel underburning. As a rule, the majority of heat power stations produce the ash and slag materials with mechanical fuel underburning of 20-30%. Such materials cannot be used. According to, for example, European standards "Fly ash for concrete", loss on ignition must not exceed 5% of mass. Thereby, in most cases, ash and slag before use must be sorted from surplus or unburned fuel until its content does not exceed 5% of mass. (Tselykovskiy U. K., Environmental and Economic Aspects of Recycling Zoloshlakov TTP. masters-.donntu.edu.ua/2009/feht/tihonova/library/article5.htm). If one takes into account that the main mass of unburnt fuel stays within small part clayey material, fritted outside i.e. in vitrified particles, such sorting is a complex process, requiring significant consumption of electric power and capital expenditures. (Calcium Silicate Bricks, Ceramic and Fused Materials Based of Ashes and Slags TTP. /bibliotekar.ru/spravochnik-110stroitelnye-materialy/16.htm).

All modern existing and proposed technologies, more than one hundred of them, do not provide preliminary clearing of the slag and ash from hazardous materials, but only "incapsulating" them (including heavy metals) in body of formed product, not letting, in the opinion of authors, toxic substances to go into the environment. (Knatko V. M., Knatko M. V., Scherbakova E. V. IMM—Technology against Waste./ Imitation of Natural Processes of Mineral Formation—a Perspective Direction of Neutralization and Recycling of Industrial Wastes. Energy: Economy, Technique, Ekology. —No 12, 2001, p. 29-35). However, a number of substances forming waste products, for example, sulphur-containing substances can cause degradation of the cement stone that result in diffusion of contaminants into the environment. Besides, toxic metals under certain conditions can be washed away from the storage blocks by rains, for example, when there is a change of acidity of rain water according to "weather conditions" ((Yufit S. S. Incinerate Factories—Rubbish Heap in the Sky. Ekoline, 1998). Since specified toxic substances pertain to more stable toxicants, it is probable that all products, made using the proposed technologies will be toxic for many years. Thereby, even though the results of the studies are positive, they do not give the reasons for broad industrial use of specified technology. Perennial quality checks of concrete products are required even in modern buildings and constructions. Thereby, the problem of rational, ecologically clean use of the slag and ash of heat power station for this moment does not have a satisfactory solution.

According to the United Nations Environment Program annually up to 50 million tons of electronic scrap is not processed, but end up in landfills. (UN Experts Have Adopted a Set of Technical Guidelines on Recycling Mobile Phones Cybersecurity.ru/hard/50582.html. The European Environmental Protection Department has counted that amount of the electronic refuse increases three times more quickly than the average municipal wastes. Computers, mobile telephones and the other device constantly are becoming cheaper and available to more people. The growing consumption of such goods and their rapid obsolescence leads to a constant increase of unwanted electronics (E-waste Threatens the World. Unprofessional Recycling Electronics Pollute Streda solidwaste.ru/news/view/1634.html/7, Mar. 2007. The UNO representatives are urgently concerned with the solution of this problem; otherwise the situation will only become worse. During an investigation, led by an international coalition of ecological organizations, it was realized that enormous amounts of refuse are exported to China, Pakistan and India. So, for example, in the USA annually only 10% of electronic scrap goes into dumps, but up to 80% is transported to developing countries where it is processed by methods harmful to the health of the people and the environment (Computer Landfills Pollute Asia. Feb. 25, 2002 news.bbc.co.uk/hi/russian/sci/tech/newsid_1840587.stm). For example, in coastal province Guandan of China up to 100 thousand migrants break and process the outdated computers from all over the world. In this work participate the men, women and children, not being aware of the harm, which is caused them and to the environment in dismantling of electronics, including incineration under open sky of the plastic parts and wire, use of acid for gold extraction, remelting and incineration of the toxic printed circuit boards, and the release of lead following breaking containing lead cathode beam tubes. Contamination in this region already so great that it is impossible to drink well water, and water necessary to bring by trucks, and written in the report (Poisonous Rubbish of Electronic Revolution. World; guardian.co.uk/online/news/ 23, Sep. 2004; Guiyang—The City of Miners from e Waste (ot.rusk.ru/section/861.

In electric and electronic equipment are used a lot of components, containing such carcinogens, as lead and arsenic, as well as such valuable metals, as copper, bronze, aluminum, silver, palladium, platinum and gold. Small quantities of magnesium, mercury, iridium, niobium, yttrium, titanium, cobalt, chromium, cadmium, tin, selenium, beryllium, tantalum, vanadium and europium are also present. The composition of the multicomponent electronic waste is not constant and depends upon the electronic device types. The main metals form 40% of the general mass of waste and include copper (50%), iron (20%), tin (10%), nickel, lead and aluminum (5% each) and zinc (3%). One ton of the electronic scrap contains an average of 1.8 kg silver, 930 g gold and 45 g palladium. (Chemyuk A. O. Current Status of Extraction of Metals from Scrap Radio Board and Their Cut Products) nbuv.gov.ua/portal/metalurg/2011_23/pdf. As of Swedish Organization of the Recycling "Abfall Schweden" and of Russian State Repository for Precious Metals, in one ton of electronic scrap on the average is present one kilogram of silver, 50 grams of gold and 150 kg of copper, but in one ton of military electronic scrap—500 grams of gold and 300 kg of copper (The Swedes have learned to dig for Gold and Silver from Old Mobile Phones. www.mobiset.ru/Articles; The Effect of "Dabby Dress" Turns Cinderella into a Princess. Business Petersburg, 36 (1145), 4, Mar. 2002)
dpgazeta.ru/article/39565). Note, that gold extraction from scrap is a complex process because gold is present as a fine surface layer on plastic, metallic, ceramic or mixed ceramic-metal base material. However, electronic scrap still contains comparatively more gold, than ore, from which it is extracted. As of Russian State Repository for Precious Metals, household electronic scrap contains in 10-15 times greater of precious metals, for example gold and copper, than ore, but military electronic scrap—has 100 times greater gold and has 30 times greater copper. So processing such stock material is vastly more profitable than processing ore. Even processing of scrap with a low content of gold and other precious metals, the collection and use of valuable components of them is more profitable as a consequence of their high cost. The Computers Will Be Recycled. mtspb.com/production_current.php?id=9&id_group=54).

The problem of salvaging the old electronics in the European Economic Community countries, Japan and USA is of high concern. In these countries there is an enormous amount of legislation encouraging, for example, collection and processing of used mobile telephones. Herewith, however, according to the data of different Ecological Associations in the world presently there are processed only 11% of discarded electronics (Clean the World of Computers. Gazeta.ru. 14, Jul. 2004. mtspb.com/production_current.php?id=9&id_group=54).

This explains why the utilization process to recycle is complex and labor intensive. The first stage in the processing is a sorting, for example, mobile telephones by manufacturers and models. After that the devices are manually disassembled—separating the bodies and other plastic parts, electronics boards, displays, metallic fragments and batteries. From electronic boards the microcircuits, connectors and elements, containing precious metals are removed. Extraction of precious metals from these components is performed by different electrochemical methods. Hereafter recovered precious metals are sent to specialized plants for additional purification. Plastic and metallic elements of bodies and the remainder of the printed boards are at the beginning crushed into small pieces, but then ground to dust, and sorted by the mechanical methods. More light dust from plastic elements is separated from "heavy" metallic dust. At this stage processing ends—sorted dust goes to processing enterprises, where it is used in production of different products. After similar conversions into secondary use goes 80-90% of the cellular telephone. The recycling of used batteries and the dumping of remaining wastes remains a concern for many specific enterprises (Golovanova N., Mobile Scrap: for Verge of the Lives. What Utilization Come to Pass. Mforum.ru. 19, Nov. 2008). An advantage of the technology is that metal extraction from electronic scrap is ten times cheaper, than extraction from ore. An important disadvantage, however, is the contamination of the environment with dusty particles of scrap, using the time and labor-consuming manual labor in process of the device disassembling at processing of superficially humid scrap due to adhesion of particles of dust makes it impossible to obtain qualitative separation to different fractions what leads to loss precious metals, and in event of the following processing of plastic dust by thermal methods, for example by pyrolysis, inevitably the formation of dioxins, pollutes the environment. Besides, high probability of the formation explosive mixture of dry dust with air at detritions, sorting and transportation by mechanical methods exists so that an electric spark can cause an explosion and destruction of the equipment.

This is explained as follows. In many branches of industry, during processing and transportation of free-flowing dielectric materials the phenomenon of static-charge accumulation by friction of the particles one on another and on air during motion exist. Electrization of material prevents the normal flow of the technological processes, as well as creates an additional fire danger as a consequence of spark formation at discharge. Grounding of the metallic parts of the equipment, increases surfaces and volume conductivity of the dielectric materials, and prevents the accumulation of significant steady-state charge by installation in a zone of electrical protection, special neutralizers which, however, frequently can not provide full electrostatic spark safety. Therefore it is overwhelmingly important to provide conditions, including electrostatic spark safety as a condition of the method, where there is a possibility of explosion and fire from static electricity is excluded (Static Electricity. The Section Overview. na5.ru/500709-1).

The known pyrometallurgical conversion of electronic industry scrap, include its firing in a rotating converter at a temperature of 1250-1350° C. for the purpose of removing organic material, in particular plastics. The gases, which evolve during firing, burn up in an afterburner chamber and are cleared from dust. After removing organic impurities, after firing scoria into a converter copper scrap and fuse are loaded. Then, the metal is blown out by oxygen for removing the metal admixtures (the iron, lead, zinc and others) and directed to the production of anodes (Scott Yames, Sabin Metal Corporation; Scotts Vilce, NY. Pyrometallurgical Conversion of Electronic Industry Scrap. The Material of 19th International Conference on Precious Metals. Incline Village, Nev., USA, 1995). An important disadvantage of the specified way is the impossibility to catch all released dioxins, greater investments and maintenance costs, related to complexity of used equipment, low productivity and high power consumption of the process.

Processes for the conversion of electronics scrap, electrical devices and equipment, consisting of organic and inorganic components, including toxic heavy metals and polychlorinated biphenyls are well known. The methods provide crushing of the scrap up to size of the particles 5-25 mm, thermal processing at the temperature 350-600° and pressure 100 kP-10 mP (1-100/sm$^2$) with a simultaneous mixing operation up to 10 minutes. As a result of depolymerizing and thermal decomposition the organic vapors and gases and solid residues of pyrolysis with a high concentration of basic and precious metals are obtained (U.S. Pat. No. 7,407,122). An important disadvantage of this technology is the presence of dioxins and heavy metals in gaseous fractions and dioxins in the solid fraction of the final products, and the high power requirements of the process.

The known method and device for extraction material from electronic and electrical scrap, including frequent crushing, division by mechanical and physical methods by cyclones and electrostatic separators with the following reception of the nonmetallic faction in the form of granules and dust and metallic faction, going after on processing by electrolytic and chemical methods or simple melting (U.S. Pat. No. 5,139,203). An advantage of the method is a high degree of division of metallic faction from nonmetallic, that allows to process the metallic faction of scrap by simple melting without using metallurgical reactions. Important disadvantage of technology—an environment contamination by dusty particles of scrap, as well as a high probability of the formation of an explosive mixture of dry dust with air, after sorting and transportation by mechanical methods so that an electric spark can cause an explosion and destruction of the equipment. After processing of superficially humid scrap due to adhesion of dust particles, it is impossible to obtain qualitative fractions separations and that leads to precious metals loss. Besides, in the event of the following processing of plastic dust by thermal methods, for example by pyrolysis, inevitably formation of dioxins results, which pollutes the environment.

The Japanese scientists from Saga University created inexpensive and efficient gels, which are capable of removing from rubbish, microparticles of precious metals. It turned out that the gel "separates out" nearly 90% of gold, platinum and palladium, herewith leaving behind copper, zinc and iron. Important disadvantage revealed by Japanese chemists—a low velocity of occurring processes. The kinetic restrictions make it impossible to widely use the gels in industry The New Gel is Making Gold with Newspapers. membrana.ru/particle/12761.

The specialists at NEC (Nippon Electric Company) have developed a new system of extraction of useful components from discarded printed circuit boards. The process known as "EcoSeparation System" consists of two main stages: EcoRemover, in the course of which mounted on printed boards electronic components mounted on the printed circuit boards, are removed, and EcoSeparation, which includes pulverizing of the boards and separation of the obtained mixture of materials. On the first stage, EcoRemover, the boards are heated up to the melting temperature of solder; fluid solder is drawn off and installed on board components which are separated from it with a small external effort. According to statements of NEC representatives, 95% of solder was collected in the course of test and separation of nearly all components from the boards without any losses. Thereafter, the stripped printed boards are transported to the second stage. As a result of realization of the process EcoSeparation it is reduced in to powder, which is then divided according to two methods: using an air centrifuge and an electrostatic high-voltage filter. The process succeeds in collection of more than 98% copper contained in printed circuit boards; nearly 100% of the fiberglass and of the adhesive resins, which are suitable for recycling end secondary use (NEC launches the "Ecoseparation System". Newsbytes. 28 Nov. 2002). Important disadvantages of technology is an environmental contamination by dusty particles of scrap, the need to use manual labor in a process of disassembling of devices for separation of the electronic boards, the possibility of the explosive mixture formation of dry dust with air in an air-centrifuge which after an electric spark can explode and destroy the equipment. After processing of superficially humid scrap due to adhesion of dust particles it is impossible to obtain qualitative division to separate fractions what leads to loss of precious metals. Besides, in the event of the following conversion of plastic dust by thermal methods, for example by pyrolysis, inevitably formation of dioxins occurs, polluting the environment.

The known method of the extraction of the precious metals from printed circuits, includes heating of the specified circuits up to the temperature of the melting solder, separation of the integral microcircuits, electro- and radio-elements from printed boards by shaking, magnetic separation with separation of the specified microcircuits, breaking them into pieces by crushing. The obtained product is subject to additional magnetic separation with allocation of the concentrate of the precious metals, which makes it possible to direct hydro-, pyro-metallurgical or plasma-chemical processing for separation of each type of the precious metal (See Russian Patent No. 2068010). An advantage of technology is that in crushing of the plastic bodies, their embrittlement occurs without breaching the whole microcircuits to provide a good extraction of the concentrate of the precious metals, incorporated in specified microcircuits, without using electric or air separation. An important disadvantage is the need to use manual labor in the process for disassembling the devices, as well as formation of dioxins, which pollute the environment, during and following processing of plastic by thermal methods, for example by pyrolysis.

The known method of the processing and recovery of electronic and electrical scrap includes providing preliminary thermal processing and removing installed on board components, crushing and separating on a strainer to particles by size 3-13 mm and more 13 mm. Particles more than 13 mm are returned for repeated crushing, particles less than 3 mm—go to a collector of dust, but particles 3-13 mm—undergo magnetic separation to give magnetic and non magnetic factions. After such a separation, repeated pulverizing, multistage separation using a strainer, separation using magnetic and electrostatic separators to obtain the base material, ceramic material and precious metals (U.S. Pat. No. 5,547,134). Important disadvantages of this method include environmental contamination by dusty particles of scrap, use of manual labor in the process of the electronic boards separation, the possibility of explosive mixture formation of dry dust with air which after an electric spark is subject to explosion and destruction of the equipment. After processing of superficially humid scrap which includes adhesion of particles of dust, it is impossible to obtain a qualitative division into separate fractions and so this leads to precious metals loss. Besides, in the event of the following processing of plastic dust by thermal methods, for example by pyrolysis, the result in inevitable formation of dioxins, which pollutes the environment.

The specialists at "Mechanobr-technology" have developed technology for the electromechanic processing of electronic and cable scrap. Outdated computers, television sets, and refrigerators, for example, in other words, all devices and electronic circuit enter the shredder wholly. The line contains the knife grinder, the knocked-rotary grinder of the first stage and the same grinder of second stage, where material is by force reduced to 5 mm granules. Hereinafter a drum bolting machine is installed, working in a closed cycle with a grinder and magnetic separator, which separates from product of the crushing intergrown pieces of magnetic metal with precious metals. Nonmagnetic material enters the electrostatic separator, where all metals are separated from nonmetal on the basis of electrical conductivity. Dust, forming during the process of the crushing and separation, is extracted by built-in aspiration system. From nonmagnetic metallic concentrates at another plant on base of hydrometallurgical process precious and non-ferrous metals are obtained (The Effect of "Dabby Dress" Turns Cinderella in a Princess. Business Petersburg, 36 (1145), 4, Mar. 2002. dpgazcta.ru.article/39565; The Complex of equipment for processing and sorting of electronic, electrical and cable scrap. mtspb.com/production_current.php?id=98id_group=54; The Computers Will Recycle. strf.ru/science.uspx?cataloged=222&d. Dignity of the technology—an exception of low productive manual breakdown of the devices. Important disadvantages of technology include that even in the presence of built-in aspiration system for extraction of dust high probability of explosive mixture formation of dry dust with air that at electric spark can cause explosion and destroy the equipment, contamination of the environment by dusty particle of scrap. Besides, in the event of the following conversion of plastic by thermal methods, for example by pyrolysis, inevitably formation of dioxins, pollute the environment.

The known methods of processing electronic and cable scrap, for example, radioelectronics scrap and electronic game equipment with extraction from them metals and sorting of plastics, includes crushing, pulverizing in hammer grinders in closed cycle with air and sieve separation by size, render particles of the material to a size smaller then 5 mm and separation by electrostatic method to electrically conductive metallic and dielectric fractions and semi-product, which returns to the repeated crushing and separation (Russian Patent No. 2166376). Advantages of the method include high efficiency of the metal separation from basic material and, accordingly, its minimum losses. Important disadvantages of the technology include environmental contamination by dusty particle of scrap, the probability of the explosive mixture formation by dry dust with air so that an electric spark may cause explosion and destruction of the equipment. After processing of superficially humid scrap because of particles of dust adhesion, it is impossible to obtain qualitative separation to separate fractions that leads to loss of precious metals. Besides, in the event of the following processing of plastic dust by thermal methods, for example by pyrolysis, inevitably formation of dioxins occurs, polluting the environment.

The known processes, require pulverizing electronic and cable scrap, separating an obtained powder in an air classifier and cyclones to obtain a significant amount and quality of metal fractions, having different physical characteristics. The cycle of the complex by air—closed with a reset of an extra amount of air through a cyclone and vortex gas scrubber into the atmosphere (Catalogue of Industrial Equipment for Reception Powder and Mixtures. Bolting Machines. Units. Classification of Powders to Produce the Required Quantity and Quality of Product Fractions. (pomol.ru). Important disadvantages include a high probability of an explosive mixture formation of dry dust with air so that following an electric spark an explosion may occur which destroys the equipment. After processing of superficially humid scrap which includes adhesion of dust particles, it is impossible to obtain qualitative separation to separate fractions that leads to loss of precious metals. Besides, even using a closed cycle by air with wet purification in gas scrubber of part of the air, discharge in to atmosphere, it is not enough to protect the environment from contamination by dusty particles of the scrap, but adding water after the scrubbing is necessary to clean or discharge in to sewerage. In the event of the following processing of plastic dust by thermal methods, for example by pyrolysis, inevitably formation of dioxins occur, which pollutes the environment.

The Company "Zhengyuan Powder Equipment" offers for processing and separation of superficially humid material as injectant the air, beforehand dried by the freeze-out (Zhengyuan Powder Engineering Equipment Co., Ltd. The Equipment Catalogue. The Block Diagram No. 1 and No. 2 with the Freeze-Out Drying Machine (chinamill.ru). Drying process of the air excludes adhesion of the dust particles and, accordingly, raises the quality of finely dispersed powder separation on fractions. The important disadvantages include a significant expense for installation and maintenance of the equipment of the dried the air by freeze-out, environment contamination by dusty particle of scrap and high probability of explosive mixture formation by dry dust with by air that fo destruction the equipment. Besides, in the event of the following processing of plastic dust by thermal methods, for example by pyrolysis, inevitably formation of dioxins occurs, polluting the environment.

The same company offers for processing and division of the fire and explosion hazardous materials as injectant instead the air to use the inert gas, for example, nitrogen. The process includes a reservoir and a source of nitrogen, nitrogen-compressor, jet mill, dedusting cyclone, pulsed deduster and the automation system (Zhengyuan Powder Engineering Equipment Co., Ltd. The Equipment Catalogue. Explosion Prevention Flow Chart (chinamill.ru). Such decision really provides overall protection of the work. However, the process vastly increases the cost of electronic and cable scrap processing due to expenses of the nitrogen production, installation of the extra equipment and creation of a completely airproof unit. Besides, in the event of the following processing of plastic by thermal methods, for example by pyrolysis, inevitably formation of dioxins occurs, polluting the environment.

The electric charges, forming on parts of the equipment, as a result of friction of particles material about one another about air and equipment during motion, can be mutually neutralized as a consequence of a certain conductivity of the humid air, as well as flow down to the land on surfaces of the equipment, but in some cases, when charges are great and the difference in potential is also great, that in view of the low moisture content of the air, a rapid electric spark can occur between electrified parts of the equipment or to the land. The energy of such a spark can be sufficient for ignition of a combustible or explosive mixture. Exceedingly it is important that under relative moisture of the air 85% and more sparks of the static electricity are absent (Static Electricity. The Section Overview. (na5.ru/500709-1) Thereby, high relative moisture of the air provides non-explosive working of the equipment for processing and transportation of loose materials. However, due to moisture condensations of humid air and, accordingly, adhesion of the dust particles occurs, and so it is impossible to obtain qualitative separation to separate factions which leads to losses, for example, of precious metal and stoppage of use of the equipment for required cleaning to remove the particles adhering to the machinery.

The known method and plant for waste processing, including electronic, electric and cable scrap, provided their preliminary crushing, separation of the ferrous metals, mix with limestone and drying-up (U.S. Pat. No. 7,611,576). The process of pyrolysis is realized in two stages with simultaneous neutralization of discharging hydrogen chloride by limestone that excludes formation and, accordingly, emission of dioxins to environment, but clear of washing water after solid products of pyrolysis extracting excludes the discharge of the heavy metals (including nonferrous and precious) in environment. The important disadvantage of specified technology:

- is not provided separation of nonferrous and precious metals from electronic, electric and cable scrap, entering for processing together with municipal waste;
- is not designed efficient circuit diagrams of the technological processes and equipment for raw materials preparation—mixing of solid municipal waste and limestone before feed in dryer and pollution of water from salts of heavy metals;
- drying of municipal waste and limestone mixture is realized in two stages—by hot air, which has been heated up due to utilizing of the heat of chimney gases from a furnace of pyrolysis and then mixing with a part of a solid product of pyrolysis (recycle), outgoing from furnace of pyrolysis. Drying of solid product of pyrolysis after its washing and centrifuging is realized by mixing with a part of hot slag (recycle), outgoing from combustion chamber. Herewith it is necessary to remove the metered-in amount of the solid products of pyrolysis and slag (that is only part from the total amount) automatically, moreover, having provided hermeticity of channels (sluicing). After that washed solid remainder of pyrolysis and slag must be transported to the combustion chamber, and heated up again. This is possible, but in a complicated way;
- is not shown possibility of the slag and ash processing of the heat power station and industrial boiler plant, working at solid fuels;
- a water supply of the steam recovery boilers realized by industrial condensate, containing calcium chloride that leads to quick incrustation on heat surfaces, frequent stoppage of recovery boilers for washing and cleaning and, accordingly, stopping operation of the whole plant.

OBJECTS OF THE INVENTION

The object of the invention—in addition to production from municipal waste (U.S. Pat. No. 7,611,576) of pollution-free commodities (including liquid fuel, dry calcium chloride, liquid carbon dioxide, mix of heavy metals salts and coke or coal, slag-concrete products and the ferrous metals as metal junk) is to obtain a concentrate of nonferrous and precious metals using a dry method of enrichment—by pulverizing electronic, electric and cable scrap with the following physical division (magnetic, electro- and air separation). Then obtained polymetallic concentrate of the nonferrous metals, enriched with platinoids, gold and silver, is transferred to plants for selective separation of each type of metal. The physical method of the enrichment is not a refining, however it is used as a preliminary stage when processing the electronic scrap. The advantage of such processing is the ease of processing quite a large quantity of the specified scrap.

The following object of the invention—to provide together with municipal waste efficient processing of the ash and slag of heat power stations and industrial boiler plants, working at solid fuels, for production of nonpolluted slag-concrete products due to preliminary washing off an optimum quantity of the ash and slag with solid products of pyrolysis of municipal waste from heavy metals, centrifuging and afterburning in combustion chamber the unburned fuel, contained in slag and ash (the reduction of level of mechanically underburning fuel in slag and ash of boiler units) before producing a slag-concrete mixture.

The following object of the invention—to simplify the technology, regulation and control of the processes with simultaneous investment and operating costs reduction due to realization of a two stage pyrolysis in the furnace of pyrolysis in single-pass mode (without recycle), drying of municipal waste and limestone mixture also without recycle in single-pass mode in the steam dryer, using steam of the recovery boilers, that allows simply and effectively processing of the waste of any moisture content, including frozen waste, heat of chimney gases and pyrolytic gases obtained by combusting or heating refuse. Mixtures of the solid products of pyrolysis of municipal waste, slag and ash of a heat or power station after washing out heavy metals using centrifuging because of their low moisture content move directly to a combustion chamber without additional dewatering and, accordingly, without recycle of the part of slag from combustion chamber. Under such a process the consumption of the heat is the same, but is structurally more simple and easy to control.

The following object of the invention to obtain, without the need to employ additional processing plants, non-metallic components of the electronic, electric and cable scrap (the polymers, including polyvinyl chloride, complex polyethers, textolite, silicones, wood, synthetic rubber and the other components) for production of a commodity liquid fuel due to their pyrolysis with municipal waste and simultaneous emission of hydrogen chloride which is neutralized by limestone that excludes formation and, accordingly, emission of dioxins in environment.

The following object of the invention—to exclude completely environment contamination by dusty particles of ground electronic scrap by creation of a closed circulating system, where air (the working agent of pneumatic transport of dusty scrap from an electrostatic separator to the furnace of pyrolysis and return of the scrap for a repeated separation in a specified separator) and after separating in cyclones, the scrap undergoes washing in a gas scrubber and again returns in to the transport system, but where excess of the air goes for cooling the slag, which leaves the combustion chamber. Part of the circulating wash water from the gas scrubber is constantly taken away to the extractor for washing off solid remainder of pyrolysis of municipal waste, slag and ash of heat power stations.

The following object of the invention—to provide efficient and non-explosive processing of electronic, electric and cable scrap by drying-out a superficially humid milled nonmagnetic scrap and heating the milled nonmagnetic scrap before separation up to 2-4° C. above the transporting air temperature, moreover, the relative humidity of the specified air after washing in a gas scrubber must be 100%. Then after mixing an optimal quantity of humid air with a specified heated scrap as a result of heat exchange, the temperature of the air increases, but the relative humidity falls to a lower level, thanks to removal of the condensate and, accordingly, excludes adhesion of the particles of the material, as well as excludes the appearance in the system of sparks caused by static electricity in order to provide efficient separator functioning and non-explosive working of the equipment.

The following object of the invention—to exclude frequent stoppages of the steam recovery boilers for washing and cleaning due to changes in the quality of the water supply by using an industrial condensate derived from chemical cleaned feed water, obtained in a water treatment plant, in a method and system which depends on the quality of the source water.

The following object of the invention—a reduction of the investment costs and reduction of the period of plant construction by employing autonomous technological line-modules containing only mass-produced equipment.

SUMMARY OF THE INVENTION

The present invention is directed to a method of processing a solid municipal waste material which includes electronic, electrical and/or cable waste, which comprises the steps of:

(a) optionally separating the electronic, electrical and/or cabled wastes from the solid municipal waste material;

(b) crushing, shredding, and pulverizing the electronic, electrical, and/or cable wastes down to a particle size of 2 to 5 mm;

(c) classifying in a screening drum the particles of electronic, electrical and/or cable waste to separate the particles of a size of 2 to 5 mm from the particles of a size larger than 5 mm;

(d) pulverizing once again the particles of a size larger than 5 mm down to a size of 2 to 5 mm, returning the particles to the screening drum, and combining the particles of the electronic, electrical and cable waste obtained according to steps (b) and (c);

(e) passing the particles of a size of 2 to 5 mm to an electromagnetic separator to separate out particles of a ferromagnetic metal so that only a non-magnetic fraction of the particles remains;

(f) drying the non-magnetic particles obtained according to step (e) to remove superficial humidity, and conveying the dried non-magnetic particles to a drum of a corona electrostatic separator, which separates the non-magnetic particles into a dielectric fraction of particles, an electrically conductive fraction of metallic particles, and a fraction of particles comprising both dielectric particles and conductive metallic particles;

(g) channeling the fraction of dielectric particles to a mixing ejector, mixing the dielectric fraction of particles with pressurized transporting air at a pressure above atmospheric pressure, passing the dielectric fraction of particles through a cyclone to remove dust, and then through a screw feeder to a furnace of pyrolysis to obtain a pyrolysis gas, and passing the pressurized air containing dust particles from the cyclone to a scrubber, where irrigating water is used to remove the dust from the transporting pressurized air, passing the dielectric fraction of particles through a slag cooler to cool the dielectric particles, through a cyclone to refine the dielectric particles, to recover a slag product useful for making concrete;

(h) channeling the fraction of dielectric particles comprising plastic and the conductive metal particles to the mixing ejector, mixing the semi-product fraction of particles with the pressurized transporting air at a pressure above atmospheric pressure, passing the dielectric fraction of particles through a cyclone to remove dust, and then through the drum of the corona electrostatic drum separator according to step (f) to separate out the electrically conductive metallic particles from the dielectric fraction of particles, passing the dielectric fraction of particles to the furnace of pyrolysis to obtain additional pyrolysis gas, and passing the pressurized air containing dust particles from the cyclone to the scrubber, where irrigating water is used to remove the dust from the transporting pressurized air passing the dielectric fraction of particles through a slag cooler to cool the dielectric particles, through a cyclone to refine the dielectric particles, to recover additional slag product useful for making concrete; and (i) combining electrically conductive metallic particles obtained according to steps (f) and (h) to recover non-ferrous metals, which include platinum group metals, gold and silver, which may then be separated into the pure non-ferrous metals.

The invention is further directed to a method of processing a solid waste material wherein according to step (f) the non-magnetic particles of electronic, electric and cable scrap after drying to remove superficial humidity are warmed 2 to 4° C. above the temperature of the ambient air transporting the particles.

The invention is further directed to a method of processing a solid waste material as defined herein above wherein according to steps (f) and (h) the corona electrostatic separator provides a specific separation of the non-magnetic particles into a dielectric fraction of particles and into electrically conductive metallic particles as a result of corona discharges from the corona electrostatic separator, said discharges passing on a contact surface of the electrically conductive metal particles and destroying the bond between the metal particles and the dielectric particles on the surface.

The invention is further directed to a method of processing a solid waste material as defined herein above wherein according to steps (g) and (h) the optimal weight ratio of dielectric fraction or semi-product to the required pressurized transporting air is 0.5 to 1.0 kg/kg of the pressurized air.

The invention is further directed to a method of processing a solid waste material as defined herein above wherein according to steps (g) and (h), the water, transported from the water treatment unit to the scrubber of air for removing dust is not chemically treated, but is physically treated to remove suspended solid substances.

The invention is further directed to a method of processing a solid waste material as defined herein above wherein according to steps (g) and (h), sufficient irrigating water is employed so that relative humidity of the air leaving the scrubber is 100%.

The invention is further directed to a method of processing the solid waste material as defined herein above, further comprising the step of (j) loading a mixture of ash and slag crushed to a size no greater than 5 mm from an electric power plant or heating plant into a lower end of an extractor whose chamber is upwardly inclined at an angle of 10 to 15°, loosening the mixture of ash and slag in the extractor through use of a rotating screw to increase its contact surface area, feeding water into the extractor at the upper end opposite the lower end through which the mixture of ash and crushed slag is loaded, to obtain a solution of heavy metals removed from the mixture of ash and crushed slag, centrifuging the obtained solution of heavy metals to separate out the heavy metals, and to obtain a filtrate, recovering the heavy metals separated from the mixture of ash and crushed slag, passing the mixture of ash and crushed slag from which the heavy metals have been removed to the furnace of pyrolysis to obtain pyrolysis gas and following the pyrolysis, passing the mixture of ash and crushed slag through the slag cooler to cool the mixture, through the cyclone to refine the mixture to recover additional slag product useful for making concrete.

Thereby, the present method and plant for processing waste may provide output on the market: liquid fuel, bars of ferrous metals, dry calcium chloride, liquid carbonic acid, mixture of heavy metal salts with coke or coal and light slag concrete. In particular after processing of the electronic, electric and cable scrap there is provided output commodity products on the market of polymetallic concentrates of non-ferrous metals, which include platinum-group metals (platinoids), gold and silver. Herewith the non-metallic part of the specified scrap (the polymers, textolite, silicones, fiberglass, organic resins, rubber and the other components) are processed into a liquid fuel. The output of the specified products depends on the composition of the municipal waste, which includes electronic, electric and cable scrap, and which may also include slag and ashes of the heat power stations and boiler plants.

The liquid fuel is used for heating buildings, in high-temperature technological process of different branches of industry, in power boiler units.

Calcium chloride is applied to accelerate concrete hardening, as a de-icer for roads, railway switches, in regulation of coal and ores, in the preparation of refrigerants, medical products, as a desiccant agent in connection with the rapid absorption of moisture from an ambient medium and in agriculture.

Liquid carbonic acid is used in the food industry, as detacher of the bakery dough, for carbonation of beverages, including nonalcoholic drinks, mineral water, beer and sparkling wine, for dry ice production, as a preservative when packing food-stuffs in modified atmosphere for increasing the period of their keeping, and for extraction of spicy-aromatic raw materials. It is also used in the chemical industry and in pharmaceuticals in the manufacture of synthetical chemical materials, neutralizing of alkaline sewage, in processes for clearing and dewatering polymers, or filaments of the animal or vegetable origin. In metallurgical engineering it is used for sedimentation of red fume in processes of scrap charge and in injecting of carbon, for reduction of the nitrogen absorption volume in process which require opening an electric arc furnace. Liquid carbonic acid is used in conversion of the non-ferrous metals, for smoke suppression in process ladleman for producing Cu/Ni) bars or Zn/Pb bars. In the cellulose and paper industry it is used for pH level regulation in processing raw material after alkaline bleaching of wood pulp or celluloses, and in welding production—as an inert ambient atmosphere for welding by wire. The containers filled with liquid carbonic acid are broadly used as fire-extinguishers and in pneumatic weapon.

The heavy metals mixture with coke or coal—a raw material for metallurgical enterprises, working with polymetallic ore minerals, where specified mixture is used as an alternative to expensive miscellaneous materials required for operating furnaces of pyrolysis.

The slag cleared of heavy metals and sulfur is used in road construction and in manufacturing of slag concrete products.

The concentrate of the non-ferrous and precious metals direct to factories, where as a result of separation getting the chemically pure metals. Extrinsic value is present in the precious metals, which can be used in the following industries:

gold—a production of the jewelry, electronic and electric industry, artistic-decorative area, stomatology;

silver—electronic, electric, photo and film industry, production of the jewelry, stomatology and medicine, mirror production;

platinum—car, chemical, jewelry, oil industry, medicine and stomatology, electrical engineering glass, production;

palladium—motor-car construction, petroleum chemistry, electronic and electric industry, production of the jewelry, medicine;

iridium—often use as work-hardening element in alloy with platinum and palladium, chemical industry, electrical engineering, instrument fabrication for heart operation, jewelry industry, laser technology, medicine;

rhodium—car industry, glass production, alloys for teeth prosthesis and jewelry, chemistries, petroleum chemistry.

Hot water obtained as a result of heat utilization of the not containing acidic components chimney gases is used for washing garbage trucks, subsurface heating of the land in hothouses, heating of water in artificial reservoir for year-round fish breeding, hot water-supply of residential area of the city or village and etc.

BRIEF DESCRIPTION OF THE DRAWINGS

The above described and other purposes, prominent features and advantages will be more clear from the subsequent detailed description where is made reference to the drawing, in which FIG. 1 is a flow diagram of a method for processing wastes.

DETAILED DESCRIPTION OF THE INVENTION

In FIG. 1, a flow diagram of a plant for processing wastes is shown. The plant works as follows. Electronic, electrical and cable wastes are separated from municipal or similar refuse and channeled directly as Stream F to bunker 108 for processing as described herein below. The remaining municipal or similar refuse A from bunker 1 enters shredder 2, where it is crushed until the size of the particles is no more than 10-15 mm, but then for separation of metallic objects passed to electromagnetic separator 3. Eliminated metallic objects by conveyor 4 are transported to a storehouse, but are then removed to a scrap-yard. Crushed municipal waste, cleaned of ferrous metals, is channeled by conveyor 5 to a classifier (inertial wobbler feeder) 6. Pieces of waste not passed through the classifier 6 are returned by conveyor 7 and elevator 8 to bunker 1 as raw waste. Waste particles no more than 15 mm pass through classifier 6 and by conveyor 9 move into mixer 10.

The limestone B from bunker 11 enters the grinder 12, where it is reduced to a powder, but then dosater 13 also moves it into mixer 10. A weight ratio of limestone to solid waste is required from 1:5 to 1:20 depending on the content of chlorine in the waste products. From conveyor 9 and dosator 13 test samples of feedstock are regularly selected for determination of the contents of chlorine in the source of municipal waste and in the ballast in limestone. The obtained laboratory data are entered in a database of a computer which controls the plant technological process. The velocities of the conveyor 9 belts and dosator 13 are linked in accordance with the content of chlorine in the waste. In the case of processing of the electronic, electric and cable scrap in mixer 10 by dosator 13 in addition the limestone is added in a quantity, sufficient for neutralization of chlorine, contained in plastic and the other components of the dielectric fractions of scrap, enter from cyclone 123 by screw feeder 28 in to the furnace of pyrolysis 29. The premises of the shopfloor must be closed, so that taking away the air needed by the process is carried out by fan 14 from upper point of the building, to exclude the emission of easily volatile and foul-smelling hazardous substances from the building environment.

From mixer 10 the mixture moves in a steam disc or tube dryer 15, working under an underpressure of 2-10 mm of water column that excludes emission of foul-smelling gases to the environment. Underpressure arises due to condensation of the steam from the steam-gas mixture, leaving dryer 15, in condenser 16 and gas evacuation of non-condensing gases by vacuum-pump 17. At the input and output of a material from the dryer 15 drum feeders 18 are installed, playing a role not only as batch feeders, but also as gas sealers, not permitting any external air intake. The dryer 15 is heated by steam from the steam recovery boilers 19 and 20 obtained from chimney gases and pyrolitic gas respectively. The temperature of the heating steam must not exceed 200° C. Such low temperature excludes local overheating and premature decomposition in the dryer 15 of chlorine-containing organic substances.

Water vapor coming out of the dryer 15 is condensed in the condenser 16 by circulating water D, entering from cooling tower 21, and the condensate goes to a tank 22, whence by pump 23, the condensate flows to a scrubber 24 to remove volatile organic impurities. Non-condensed gases are sucked away by vacuum-pump 17 and move to burners 25 in the combustion chamber 26.

The mixture of the rubbish and limestone is exsiccated in dryer 15 and by elevator 27 and screw feeder 28 goes to the furnace of pyrolysis 29, which operates by using a rotating drum externally heated by the chimney gases coming from the combustion chamber 26 located below. External and internal surfaces of the drum are supplied with spiral edges that increase the surface of heat exchange and, accordingly, intensify the pyrolysis process. The heating process is carried out in single-pass mode in two stages without access of the air using heat from the chimney gases, moving along the outside surface of the drum in counter-flow with the pyrolysis mixture. For excluding intake of air and chimney gases into the chamber of the furnace of pyrolysis, the process works under an additional pressure of 5-10 mm of water column. At the first stage as soon as the temperature moving in a single-pass mode (without recycling) along the drum of the furnace of pyrolysis is fixed within 220-250° C., the decomposition reaction of chlorine-containing organic components of refuse, for example, polyvinylchloride occurs. Thus all chlorine contained in the refuse is converted to hydrogen chloride (HCl) which practically at the moment of formation reacts with limestone powder and thus is removed from the process with formation of calcium chloride ($CaCl_2$)

$$2HCl+CaCO_3=CaCl_2+CO_2+H_2O$$

By moving the material along the drum of the furnace of pyrolysisit's the temperature of the material quickly rises. The second stage of pyrolysis is carried out at a temperature of 450-500° C. Because the process is conducted without access to oxygen and because chlorine has been removed from the process during the first stage of pyrolysis, formation of chlorinated dioxins, furanes and biphenyls is prevented.

The solid residues of the products of pyrolysis are removed from the furnace of pyrolysis 29 and passed into the extractor 30, where in the beginning the solid residues are cooled by water to 80° C., but then over 1.5 hours, the solid residues are agitated with hot-water for dissolution of calcium chloride ($CaCl_2$) and for extraction of ions of metals, including radioactive metals, from the pores of solid particles. The solid residues of pyrolysis go into the bottom part of the extractor 30 whose chamber is inclined 10-15° from the horizon. In the same place mixture K of ash and slag crushed to a particle size no more than 5 mm enters the extractor from heaps of ash and slag from a heat or power station. A rotating screw moves up the solid phase to the top end of the extractor, mixing it with water, loosening and crushing the solid phase that creates a large surface of contact accessible for hot water. Water enters at the opposite end of the extractor and after passage through all its length leaves through a netted baffle plate on the intake of a pump 31, a part of the water recirculates into the bottom of the extractor, in order to avoid formation of stagnant zones on its bottom and part on diluting the suspension for aiding its transportation to centrifuge 32. Other water with dissolved salts of heavy metals and calcium chloride together with a filtrate from the centrifuge 32 through a cartridge filter 33 by a pump 34 move in a heat exchanger 35. The optimal weight ratio of extractive water to solid residues of the products of pyrolysis, ash and slag is 2:1 that corresponds to a degree of the heavy metal extraction of 90%. The optimal weight ratio of solid residues of the products of pyrolysis of municipal waste to ash and slag is required from 4:1 to 2:1 depending on the dispersability and grain distribution of ash and slag. It should be noted that fly ash upon mixing with water and activation with an alkaline substance, for example, limestone, take on the characteristics of cement and can serve as its substitute. The economy of the cement depends on the ash quality, on the ash and slag composition and on the concrete mixture and is defined directly in the process of the working plant.

Then water together with calcium chloride and other salts dissolved therein enters a unit for water treatment to remove heavy metal salts, in which a method is used which employs water clearing on coal or coke followed by electro coagulation. Such a process allows removing from the water solutions 99.9% of the heavy metals contained therein. In the beginning water solution from heat exchanger 35 goes into mixer 36, where adsorbent E (coal or coke) is fed from gage tank 37. Backfilling of adsorbent is carried out with a working mixer. Under mixing for 5-10 minutes a suspension is formed with contents of the solid particles 0.5-1%, which by sludge pump 38 continuously goes to the bottom of the column 39, filled by adsorbent, forming a filtration layer. For improvement of the contact of water and ions of heavy metals with a surface of the porous sorbent and adduction of adsorbent layer in a condition of fluidization by pulsations in column 39 generated by means of pulsator. The air for this is given by compressor 40. In separation camera of the column 39 the water is separated from solid particles and enters the bottom of electrocoagulator 41. The solid particles together with a part of the water enter settlement tank 42. In settlement tank 42 solid particles are precipitated to the bottom of the device and to prevent its filling are intermittently removed in tank 43, having a screw unloading means. Then mixture H of coke or coal with absorbed heavy metals is unloaded from tank 43 and moves to metallurgical plants, working with polymetallic ores. The supernatant water from tank 43 is decanted in tank 44, but then by sludge pump 45 is returned to mixer 36. Water, entering for final clearance in electrocoagulator 41, travels through its filler (the metallic chip scrap mixed with short-grained coke), entrapping ions of heavy metals as a result of the steady-state electromagnetic field, and goes into tank 46 containing clean water. Then pump 47 pumps the water, cleaned from heavy metal salts and containing calcium chloride (the concentration is 7-12% $CaCl_2$), which goes into heat exchanger 35, where it is warmed up by liquid coming out of extractor 30 and centrifuge 32, fed by pump 34. Then water, cleaned from heavy metal salts, again enters extractor 30. A part of water by pump 88 moves in spray dryer 89, utilizing heat of the chimney gases from the furnace of pyrolysis, for reception of the dry calcium chloride that completely excludes the discharge of the industrial sewages.

Water vapors leaving the extractor 30 are condensed in the condenser 48 by recycled water feeding by pump 49 from the cooling tower 21, condensate comes back into the extractor 30. Non-condensed gases move by the fan 50 to the burners 25 of the combustion chamber 26. The solid phase by the rotor device of the extractor 30 is unloaded into the centrifuge 32 with automatic screw unloading of sediment (decanter). Moisture of washed solid products of pyrolysis of municipal waste, ash and slag of heat or power stations at the output from the centrifuge depends on its separation factor which is equal to 6-15%. The ash, slag and solid products of pyrolysis dried in such a way goes by an elevator 51 and a screw feeder 52 into a bunker 53 of the combustion chamber 26, located below the furnace of pyrolysis 29.

In the combined grate-fired combustion chamber 26 gaseous and liquid products of refuse pyrolysis are burnt, non-condensed gases from the condenser units are deodorized and burnt. The solid washed out products of pyrolysis, basically carbon, are burnt in a layer on a moving chain-grate stoker on a surface of a grate bar lattice 54. The thickness of the layer is adjusted by a gate 55. While moving into the depth of the combustion chamber on a slowly movable grate bar surface, the solid products of pyrolysis, unburned fuel, slag and ash of heat power stations are heated up, ignited and burnt up. The slag is dumped into the cooler of slag 56 where it is cooled by air line C forced by a fan 14. The consumption of the air is strictly specified and is defined by how much air is needed in the combustion process in combustion chamber 26 that provides its further full use. Then air heated in heat exchange with a cooler of the slag 56, through cyclone 57 by a fan 58 in each of zones is blown through blast tuyeres 59, under the grate bar lattice 54, into the burners 25 and air nozzles 60 of combustion chamber 26.

The work of the combustion chamber is carried out by a method of three-stage burning. This method of nitrogen oxides emission decrease differs in that it does not reduce the formation of NOX, but restores already formed nitrogen oxides. The essence of the method consists in that in the combustion chamber 26 the burners 25 work with a lack of air (60-85% of the stoichiometric amount) and are installed higher than the surface of the grate bar lattice 54. As a result products of incomplete combustion which serve as reduction gases are formed. Interaction of these gases with the nitrogen oxides, formed during the burning of solid waste products of pyrolysis and not with burnt down fuel of ash and slag in a layer on the surface of the grate bar lattice 54 results in reduction of nitrogen oxides (NO) down to molecular nitrogen ($N_2$). Regulation of air supply to the burner 25 is corrected depending on the nitrogen oxides content in the chimney gases from the combustion chamber 26. Above the burners 25 burning liquid and gaseous products of pyrolysis the nozzles 60 of sharp blasting are located through which air for afterburning of incomplete combustion products moves. Thus, the inside of the combustion chamber includes three burning zones: a zone of burning of the washed out solid residues of pyrolysis and not burnt down fuel of the ash and slag, deposited on the surface of the grate bar lattice 54, a zone of secondary burning and reduction of nitrogen oxides down to molecular nitrogen and a zone of tertiary burning—afterburning of incomplete products of combustion from the second zone. Using this method in combination with watered fluid fuel allows vastly lowering emissions of nitrogen oxides ($NO_x$) in comparison with traditional methods of burning. With the absence of oxygen, carbon monoxide (CO) is formed in the furnace of pyrolysis 29 and so afterburning of the carbon monoxide is carried out in the combustion chamber 26 up to carbon dioxide ($CO_2$). Neutralization of hydrogen chloride (HCl) formed during the first stage of pyrolysis excludes its inflow to the combustion chamber 26 and, accordingly, formation in the combustion chamber of chlorinated dioxins, furans, and biphenyls is excluded too. The part of solid products of the pyrolysis, ash and slag which falls through the grate bar, and is not burned goes into the bunker located on the surface of the grate bar lattice 54, but then by elevator 51 and screw feeder 52 are again fed to bunker 53 of combustion chamber 26. The fine particles of soot, slag and ashes left behind in the furnace of pyrolysis 29 are then directed to a slag pocket of the combustion chamber 26 by a fan of ablation 61. These actions together with regulation of the velocities of the motion on the surface of the grate bar lattice 54 and thicknesses of the layer by a gate 55 provide mechanical underburning of fuel no more than 5%, as it required for production of concrete products. Fuel from external sources is brought to the burners 25 only during the start-up period of the plant.

The chimney gases from the combustion chamber 26 go on to heat the furnace of pyrolysis 29 after which the chimney gases pass through a cyclone 90 where they are freed from carried away dust, which then is loaded by screw feeder 28 in the furnace of pyrolysis 29. From cyclone 90 chimney gases enter the steam recovery boilers 19, but then by an exhauster 91 are dried of the solution of calcium chloride, the main part of the gas moves in the spray dryer 89, but the rest of the gas—to a screw dryer 92 for final drying of the solution. Excess chimney gases are vented by an exhauster 62 from the chimney stack 63 of the plant. The consumption of the gas in the dryers 89 and 92 is supported automatically by a system of the block of the flow correlations by test indication of the chimney gases temperature at output from spray dryer 89 and screw dryer 92. The initial solution with a concentration 7-12% of calcium chloride ($CaCl_2$) is evaporated in the spray dryer up to 50-70% of concentration and flows down in the screw dryer 92, where as a result of the heat of the chimney gases coming in the beginning in a jacket and then in a screw zone of the dryer itself, the calcium chloride is completely dried up to a residual humidity no more than 0.5% and then goes to cooling in a screw cooler 93, then packing in a bag 94 and unloading in a storage facility. Cooling is carried out by recycled water D from the cooling tower 21.

The moist chimney gases after drying of calcium chloride go to a cyclone 95 where the gases are separated from drops of a solution carried away and by an exhauster 96 move into the economizer 98 to heat water for process needs (floor, equipment, garbage trucks washing, heating and hot water supply to the plant etc) as well as in chamber 104 of heat-carrying agent preparation, after which enter in chamber 97 for thermohumid processing of slag-concrete. From economizer 98 cooled chimney gases go to unit 99 for manufacturing of carbon dioxide. This unit works by the standard absorption—desorption method of carbonic acid recovery from the chimney gases with the help of monoethanolamine (on the circuit it is not shown). The quantity of the gases available for manufacturing of carbonic acid and, accordingly, the productivity of the installation is limited by the thermal balance of the system, i.e. that quantity of heat which can be applied for heating of a desorber of the unit 99 water steam, received in recovery boilers 19 and 20 respectively of pyrolytic gas and chimney gases, bound by steam lines through pressure-reducing cooling station 66. The water steam also goes to dryer 15 and heater 67 of the fluid products of pyrolysis (the fluid fuel). The condensate goes into condensate tank 68 and feed-condensate pumps 69 and 70 are given accordingly in recovery boilers 20 and 19, respectively of pyrolytic gas and chimney gases. For reinstatement of the condensate in the condensate tank 68 demineralized water G is pumped from water treatment unit 100. Demineralized water G goes as well to the pressure-reducing cooling station 66. The method of the water treatment in water treatment unit (sodium cycle, sodium-chlorine cycle, hydrogen cycle, ammonium-sodium cycle, magnetic method, etc) depends on quality of source water I, but the water treatment unit consists of standard equipment. A part of pretreated water in water treatment unit J (clarified water from suspended substances, for example, in crystal filters) is fed in a scrubber 101. Chemical treatment of the specified water is not required.

The chimney gases of unit 99 cleared from carbon dioxide ($CO_2$) by an exhauster 130 are dumped in the chimney stack 63 of the plant. Thus, the content of carbon dioxide in the exhaust chimney gases of the plant dumped in an atmosphere in comparison with factories using incinerators is vastly reduced because part of the carbon remains in the liquid fuel, going for sale on the commercial market, the given technology does not use additional fuel and a part of the formed carbon dioxide is manufactured as a (carbonic acid) commercial product.

Slag from the combustion chamber 26 goes into the drum of slag cooler 56, which is used as a drum dryer. The motionless end face entrance of the slag cooler and 15-25% of the rotating drum length on the side of the input of slag, lined by firebrick with fire resistance not less then 1200° C., the other part is supplied with internal nozzles for slag transporting that help its shoveling, the best air flow and the caked pieces crushing. Owing to rotation of the drum, slag goes to it unloading end being cooled down to a temperature of 50° C. by air line C coming towards the drum. The consumption of the air is strictly regulated and is defined by the requirements of the burning process in the combustion chamber 26 that provides its further full use, excludes emission of used air and, accordingly, excludes organic and foul smelling substances contained in it and their release into the environment after blowing away of the water phase in scrubber 24. Taking away the air in air line C by fan 14 from an upper point of the branch of preparation of refuse (on the circuit it is not shown) creates a small underpressure in volume of the shopfloor and excludes the release of highly volatile and foul-smelling hazardous substances outside of the building to the environment. The cooled slag refined from heavy metals and sulphur goes into bunker 64, but then depending on local conditions leaves by car to the consumer or moves on to production of nonpolluting slag concrete products in concrete mixer 102, where the cooled slag is in addition treated with a water solution of the calcium chloride, produced according to given technologies and which provides speeded-up concrete setting, as well as necessary components, for example, portland cement, crushed bricks, gypsum etc., obtained from external sources. The composition of mixes depends on local conditions and can vary over a wide range. The received mix goes for modeling and compaction on a vibration platform 103 and then moves the chamber 97 for thermohumid processing of concrete products through a tunnel with the band conveyer located inside on which the concrete products formed earlier slowly move. For speed adjustment of a band the drive of the conveyer is supplied with a speed regulator. Inside the tunnel is water-proofed and heat insulated. The floor is made with gradient aside pit for collecting of the condensate. In the top part in the beginning and the end of the tunnelbranch pipes are located for an exit of chimney gases and in the center of the floor—a branch pipe with a ventilating cap for an entrance of vapor-gas mixture (chimney gases with relative humidity 100%) from a chamber of heat carrier preparation 104. The humid chimney gases after of the dryers of calcium chloride 89 and 92, moving through cyclone 95 by the exhauster 96, intermix with vented steam of the extractor 30, moving by exhauster 105 to the chamber 104. Recycling of waste final damp chimney gases reduces by 2.5 times the consumption of steam in comparison with the existing units, using steam for steaming of concrete. Besides, the possibility appears of use of waste low potential vented steam of technological equipment (of the extractor 30) that in addition excludes the expenses, related with steam production and water consumption for condensation of vented steam in the condenser 48. The cycle of heat treatment: temperature increase of concrete products up to 65-70° C. within 2-3 hours, isothermal maturing of concrete at the specified temperature for 14 hours and cooling for 2-3 hours. Depending on the composition of concrete the heat treatment cycle can easily be adjusted over a wide range. Exhausters 106 mounted on exits of chimney gases are supplied with axial directing devices and two speed electric motors that provide effective regulation of productivity in the wide range of loading and venting of the chimney gases from the chimney stack 63 of the plant.

The work of the chamber 97 of thermohumid processing of concrete products is carried out as follows. Simultaneously with loading of concrete products into the chamber 97 damp chimney gases (relative humidity 100%) enter chamber 97 from chamber of heat carrier preparation 104. Thus, inside the chamber 97 the humid inert environment is capable to speed up all processes directed to the full maturing of concrete. Adjusting the productivity of the exhausters 106 inside the chamber 97, different intensities of steam streams and gas mixes along the lines of particular concrete products are established and, accordingly, their temperature mode of heating, ageing and cooling is adjusted. The condensate recovered from a steam and gas mix goes in the pit of the chamber of processing of concrete and through a cartridge filter 33 by a pump 107 is moved to a tank 46 of cleaned water.

The pyrolytic gas from the furnace of pyrolysis 29 at a temperature 450-500° C. flows to a cyclone 65 where it is cleared from the dust, carried away, which is returned by the screw feeder 28 back into the furnace of pyrolysis 29. Then pyrolytic gas goes into the recovery boiler 20, after which the gas goes in a vertical tubular heat exchanger 71 where its condensation by recycled water D from the cooling tower 21 and in a scrubber—chemisorber 72 for final condensation and clearing of gases and vapors is carried out by an irrigation of its own condensate cooled in a vertical heat exchanger 73 by recycled water D from the cooling tower 21. In case of disturbance of a technological mode when an increase of acidity of a pyrolytic gas condensate is possible for neutralization of a sour impurity by a metering pump 74 from a tank 75 supplied with an anchor mixer automatically under an indication of pH-meter wherein a neutralizing solution is carried on automatically. Circulation of a condensate is carried out by a pump 76. Simultaneously the condensate from the scrubber—chemisorber 72 goes into a separating vessel (oil sump) 77 where it is separated into water and organic phases which accumulate in corresponding tanks 78 and 79. The noncondensed part of pyrolytic gas by a fan 80 goes on burning to the burners 25 of the combustion chamber 26. The organic phase of a condensate of a pyrolytic gas from the tank 79 is pumped through a cartridge filter 33 by a pump 81 and partially goes as fuel to a fuel storage facility in reservoir 82, and is thereafter pumped by a pump 83 into truck tanks and partially—to the burning in the burners 25 of the combustion chamber 26. The water phase from the tank 78 is pumped through the cartridge filter 33 by a pump 84 and scrubbed in the scrubber 24 which is carried out by hot air supplied by the fan 85, to blow away volatile organic substances from the water phase. The process is carried out utilizing the difference in partial pressure of the light organic substances in water and in the air and their direct contact results in enrichment of the air by organic substances.

The water phase, after most of the organic compounds have been blown away is pumped from the scrubber 24 by pump 86 through heat exchanger 35 and moves to a stage where solid residues of pyrolysis of municipal waste, ash and slag of the heat power stations and boiler-houses are washed in the extractor 30. The air saturated by vapors of organic substances and moisture, is fanned by the fan 87 and mixed with the main air stream, coming out from slag cooler 56. The mixture of flows enters the cyclone 57, where is cleaned to remove particles of the slag and ashes and by the fan 58 is blown into combustion chamber 26. Small slag particles collected in cyclone 57 are carried away by air flow and by elevator 51 return to combustion chamber 26.

During start-up of the plant for warming up and stabilization of all streams, i.e. reaching of material and heat balances of all processes fuel or fuel from other sources (fuel oil or gas) obtained beforehand, is fed to burners 25 of the combustion chamber 26.

Electronic, electric and cable scrap F (the outdated televisions sets, tape-recorders, telephones, slot machines, computers, cables, wire and the other products) are loaded in bunker 108 wholly. Here scrap from outside sources can also be loaded. Then in rotary-knife shredder 109 specified devices demolishing, and their debris are going high in speed impact-rotary disintegrator 110 of first stage, where pieces of the scrap are crushed down to a size of 2 to 5 mm and due to the inertia differences between dielectric substances and metal the weak bonds between these substances are broken. Then product from disintegrator 110 enters screening drum 111 for classification, with separation of the material by size where remaining particles of the metal and plastic are selectively reground and destroyed by deburring. From screening drum 111 particles more than 5 mm are sent by elevator 112 for repeated pulverization in an impact-rotary disintegrator 113 of a second stage, and then back to screening drum 111. The particles of the material less than 5 mm enter an electromagnetic separator 114, where the particles are divided into two fractions. The particles of the ferromagnetic metals driven out by conveyor 115 go to a storehouse, and then removed to a scrap-yard. The remaining non magnetic fraction of particles forming a fine layer is placed on conveyor 116; the thickness of the layer is adjusted by a gate 117. Then moving on conveyor 116 non magnetic product is exsiccated from superficial moisture and warmed 2-4° C. above the transporting air temperature, by using a high-pressure fan 118. The heating can be realized, for example, by quartz lamps 119 with a nickel-chromium spiral, by infrared lamps or by other ways. Then the exsiccated and warmed up non magnetic fraction of non-magnetic particles enters an electrostatic drum separator 120. Preliminary drying of the material provides high-efficiency work of the electrostatic separator due to elimination of the particles of the material adhesion, which includes granular inherently humid materials. As required separation of metal and plastic with simultaneous division of specified plastic by type, for example, separation of polyvinyl chloride (PVC) from polyethyleneterephthalate (PET), is carried out in an electrostatic separator with special specially adapted for specific types of plastic. If separation of plastics by type is not required, for example, when whole plastic and the other non-metallic materials are subjected to pyrolysis to obtain hydrocarbon fuel, it is expedient to use a drum corona—electrostatic separator, in which the metallic grounded drum includes a precipitation electrode, and the corona high-tension electrode provides the corona discharges, which pass mainly on the contact surfaces of the metal and dielectric particles and destroy the bonds on this surface, providing division of the metal and dielectric. The power supply to corona electrode is provided by high-tension generator 121. Simultaneously the particles get the electrostatic charge, moreover, the metal will immediately return it to the drum the low-tension precipitation electrode and falls from the drum as a neutral granular material. The dielectric adheres to the drum and comes off already under the drum, forming its own flow. The fraction, which includes particles of the metal and plastic falls in its tank between the first and second flow. Thereby, in bunkers, located in a lower part of separator 120, electrically conductive metallic fraction, fraction of metallics and dielectrics and dielectric fractions all accumulate.

The dielectric fraction (plastic, wood, fiberglass, organic resins, rubber, etc.) through drum feeder 18 enters mixing ejector 122, mixes with air, provided by high-pressure fan 118, and enters cyclone 123, and then by screw feeder 28 is loaded in the furnace of pyrolysis 29. The optimal weight ratio of dielectric fractions with air that is required is 0.5-1.0 kg/kg of air. The air used in cyclone 123 is fanned by fan 124 to the scrubber 101, where the air is irrigated by water J, clarified from suspended substances, entering from water treatment unit 100.

The fraction of metallics and dielectrics (basically particles of the metal and plastic) similarly to the dielectric fraction enters through drum feeder 18 in mixing ejector 125, also mixed with air, provided by high-pressure fan 118, enters cyclone 126, and is returned to the electrostatic drum separator 120 for repeated processing. The optimal weight ratio of the fraction of metallics and dielectrics with air that is required is also 0.5-1.0 kg/kg of air. The used air from cyclone 126 goes by fan 127 to the scrubber 101, where the air is irrigated by water J, which was clarified from suspended substances, from water treatment unit 100.

The composition entering for scrap processing is not constant, accordingly, the amount of dielectric fraction and semi-product of the specified scrap also is not constant, and requires transporting regulation air for consumption in a system of pneumatic transport. In this connection boosting circulating system of pneumatic transport, as well as filling by air L at period of the starting the unit is realized right in to the scrubber 101 due to underpressure, created by high-pressure fan 118. As required excess of the air of the pneumatic transport system is automatically thrown in system of the slag cooling directly on the intake of the fan 14 that completely excludes environmental contamination by dusty particles of scrap.

The direct contact in the scrubber 101 of the air, containing the remainder of the dust dielectric fraction and semi-product, with water, obtained from water treatment unit 100 where the water was cleaned from indiscernible substance, cleans the air from the specified remaining dust. The intensity of the irrigation of the air by water must be adjusted so, that the relative moisture of the air obtained as output from the scrubber 101 is 100%. Then water from the scrubber 101 by pump 128 returns from irrigation of the air, a part of water constantly, depending on contents of the admixtures, travels through heat exchanger 35 to the washing stage of the solid remainder of pyrolysis in extractor 30 or clearing stage in mixer 36, and then again to extractor 30. The air saturated by humidity by again goes by fan 118 to mixing ejectors 122 and 125, where it mixes with reduced material, and is warmed up to 2-4° C. above temperature of the specified air. In the mixing process as a result of heat transfer by ambient contact of particles of the product a fine-spun heat boundary layer film is formed of the motionless air, within which temperature changes from level, equal temperature of the particle of the material, to the temperature of the air far from the product. Thereby, directly next to particles of the product due to the increase in temperature of 2 to 4° C., the relative moisture of the air falls to 78-89% eliminates moisture condensation from the air and, accordingly, the adhesiveness of particles of the material, facilitates highly efficient working of the separating units. When the mixture reaches the heat balance, i.e. stabilizations of the flow of the air and particles of the product, the temperature of the specified flow is fixed at 1.3-2.5° C. above the original temperature of the entering humid air. Herewith, relative moisture of the air falls to 88-92% which also eliminates the moisture condensation from the air and adhesion particles of the material. Simultaneously, due to relative moisture of the air more than 85%, electric sparks do not appear which provides a non-explosive working system. Besides, sucking out dusty air (suction) directly from equipment of the unit for processing of scrap is achieved by air obtained from high-pressure fans 124 and 127. In this case in the area of the air pipelines after specified fans air ejectors 131 are installed, made in the manner of a Venturi pipe with a central supply of dusty air from the equipment. Such dedusting of the equipment additionally reduces probability of the static electricity sparks.

The metallic fraction, presenting itself as a polymetallic composition of the non-ferrous metals, fortified by the platinum-group of metals (platinoids), gold and silver is packed in a laminated bags 129 and leaves to for a refinery, where the polymetallic mixture separates to chemically pure metals.

The following examples are given in illustration at the present invention, but in no way limit the scope of the invention.

The Example 1

The weight ratio of dielectric fraction of electronic and cable scrap with transporting air of pneumatic conveying system equal 0.5 kg/kg of air. The parameters of the air: temperature—20° C., relative moisture—100%. The dielectric fraction temperature of the scrap is 22° C. In process of the mixing due to heat transfer of ambient contact of particles of the product is formed fine-spun heat boundary layer film of the motionless air, within which temperature changes from 22° C. to 20° C. Herewith relative moisture of the air in specified layer falls to 89%, that excludes the condensation moisture from air and, accordingly, adhesiveness particles of the material, provides high-efficiency work of separating units. After stabilization of the flow the temperature 21.4° C. and, accordingly, relative moisture 92% (more than 85%) is fixed, that simultaneously eliminates the condensation moisture from the air, adhesiveness particles of the material and electric spark occurrence i.e. it is provided high-efficiency work of separating units and non-explosive working of the equipment.

The Example 2

The weight ratio of dielectric fraction of electronic and cable scrap with transporting air of pneumatic conveying system equal 0.5 kg/kg of air. The parameters of the air: temperature—20° C., relative moisture—100%. The dielectric fraction temperature of the scrap is 24° C. In process of the mixing due to heat transfer of ambient contact of particles of the product is formed fine-spun heat boundary layer film of the motionless air, within which temperature changes from 24° C. to 20° C. Herewith relative moisture of the air in specified layer falls to 78%, that excludes the condensation moisture from air and, accordingly, adhesiveness particles of the material, provides high-efficiency work of separating units. After stabilization of the flow the temperature 22.3° C. and, accordingly, relative moisture 88% (more than 85%) is fixed, that simultaneously eliminates the condensation moisture from the air, adhesiveness particles of the material and electric spark occurrence i.e. it is provided high-efficiency work of separating units and non-explosive work of the equipment.

The Example 3

The weight ratio of dielectric fraction of electronic and cable scrap with transporting air of pneumatic conveying system equal 1.0 kg/kg of air. The parameters of the air: temperature—20° C., relative moisture—100%. The dielectric fraction temperature of the scrap is 22° C. In process of the mixing due to heat transfer of ambient contact of particles of the product is formed fine-spun heat boundary layer film of the motionless air, within which temperature changes from 22° C. to 20° C. Herewith relative moisture of the air in specified layer falls to 89%, that excludes the condensation moisture from air and, accordingly, adhesiveness particles of the material, provides high-efficiency work of separating units. After stabilization of the flow the temperature 21.3° C. and, accordingly, relative moisture 92% (more than 85%) is fixed, that simultaneously eliminates the condensation moisture from the air, adhesiveness particles of the material and electric spark occurrence i.e. it is provided high-efficiency work of separating units and non-explosive work of the equipment.

The Example 4

The weight ratio of dielectric fraction of electronic and cable scrap with transporting air of pneumatic conveying system equal 1.0 kg/kg of air. The parameters of the air: temperature—20° C., relative moisture—100%. The dielectric fraction temperature of the scrap is 24° C. In process of the mixing due to heat transfer of ambient contact of particles of the product is formed fine-spun heat boundary layer film of the motionless air, within which temperature changes from 24° C. to 20° C. Herewith relative moisture of the air in specified layer falls to 78%, that eliminates the condensation moisture from the air and, accordingly, adhesiveness particles of the material, provides high-efficiency work of separating units. After stabilization of the flow the temperature of 22.5° C. and, accordingly, relative moisture of 89% (more than 85%) is fixed, that simultaneously eliminates the condensation moisture from the air, adhesiveness particles of the material and electric spark occurrence i.e. it is provided high-efficiency work of separating units and non-explosive work of the equipment.

What is claimed is:

1. In a method of processing a solid municipal waste material which includes electronic, electrical, and/or cable waste, in which the electronic, electrical, and/or cable waste is optionally separated from the solid waste material remaining, the improvement which comprises the steps of:

(a) shredding the electronic, electrical, and/or cable waste to form shredded electronic, electrical and/or cable waste, crushing the shredded electronic, electrical and/or cable waste, pulverizing the shredded electronic, electrical and/or cable waste down to particles of a particle size of 2 to 5 mm; classifying the particles according to particle size, wherein the particles of a size greater than 5 mm are again pulverized and again subjected to classification, and feeding the particles of a size less than 5 mm to an electromagnetic separator, to divide the particles into two fractions, a ferromagnetic fraction of particles, and a non-ferromagnetic fraction of particles;

(b) conveying the non-ferromagnetic fraction of particles to a dryer; drying the non-ferromagnetic fraction of particles in the dryer to remove superficial humidity; warming the dried non-ferromagnetic fraction of particles; and separating the non-ferromagnetic fraction of particles in a corona-electrostatic separator into a fraction of dielectric particles comprising plastic, a fraction of particles which comprises both dielectric particles comprising plastic, and an electrically conductive non-ferromagnetic fraction of metallic particles;

(c) mixing the fraction of dielectric particles comprising plastic with air, and pyrolyzing the fraction of dielectric particles comprising plastic to obtain a pyrolysis gas;

(d) mixing the fraction of particles comprising both dielectric particles comprising plastic and electrically conductive non-ferromagnetic metallic particles with air, subjecting the fraction of particles comprising both dielectric particles comprising plastic and electrically conductive non-ferromagnetic metallic particles to an air pressure above atmospheric pressure, scrubbing the fraction of particles comprising both dielectric particles comprising plastic and electrically conductive non-ferromagnetic metallic particles to remove dust, and returning the cleaned fraction of particles comprising both cleaned dielectric particles comprising plastic and the electrically conductive non-ferromagnetic metallic particles to the corona-electrostatic separator of step (b) to separate out additional electrically conductive non-ferromagnetic metallic particles and additional dielectric particles comprising plastic;

(e) combining the additional electrically conductive, non-ferromagnetic metallic particles obtained according to step (d) with the electrically conductive non-ferromagnetic fraction of particles obtained according to step (b) and optionally separating the combined electrically conductive non-ferromagnetic metallic particles into chemically pure metals including platinum group metals, gold and silver, and recovering the chemically pure metals; and (f) combining the additional dielectric particles comprising plastic obtained according to step (d) with the fraction of dielectric particles comprising plastic obtained according to step (b) to produce additional pyrolysis gas.

2. The method of processing a solid municipal waste material defined in claim 1 wherein the solid municipal waste material includes a mixture of ash and slag from an electric power plant or heating plant, the improvement which further comprises the steps of:

(g) crushing the mixture of ash and slag to a size no greater than 5 mm;

(h) loading the mixture of ash and slag into a lower end of an extractor whose chamber is upwardly inclined at an angle of 10 to 15°;

(i) loosening the mixture of ash and slag in the extractor through use of a rotating screw to increase its contact surface area;

(j) feeding water into the extractor at the upper end opposite the lower end through which the mixture of ash and crushed slag is loaded, to obtain a solution of heavy metals and to remove the heavy metals from the mixture of ash and crushed slag;

(k) centrifuging the obtained solution of heavy metals to separate out the heavy metals;

(l) recovering the heavy metals separated from the mixture of ash and crushed slag;

(m) passing the mixture of ash and crushed slag from which the heavy metals have been removed to a furnace of pyrolysis to obtain pyrolysis gas; and (n) following the pyrolysis, passing the mixture of ash and crushed slag through a slag cooler to cool the mixture, and through a cyclone to refine the mixture to recover additional slag product useful for making concrete.

3. A method of processing a solid municipal waste material which includes electronic, electrical and/or cable waste, which comprises the steps of:

(a) optionally separating the electronic, electrical and/or cabled wastes from the solid municipal waste material;

(b) crushing, shredding, and pulverizing the electronic, electrical, and/or cable wastes down to a particle size of 2 to 5 mm;

(c) classifying in a screening drum the particles of electronic, electrical and/or cable waste to separate the particles of a size of 2 to 5 mm from the particles of a size larger than 5 mm;

(d) pulverizing once again the particles of a size larger than 5 mm down to a size of 2 to 5 mm, returning the particles to the screening drum, and combining the particles of the electronic, electrical and cable waste obtained according to steps (b) and (c);

(e) passing the particles of a size of 2 to 5 mm to an electromagnetic separator to separate out particles of a ferromagnetic metal so that only a non-ferromagnetic fraction of the particles remains;

(f) drying the non-ferromagnetic particles obtained according to step (e) to remove superficial humidity, and conveying the dried non-ferromagnetic particles to a drum of a corona electrostatic separator, which separates the non-ferromagnetic particles into a fraction of dielectric particles comprising plastic, an electrically conductive fraction of non-ferromagnetic metallic particles, and a fraction of particles comprising both dielectric particles comprising plastic and electrically conductive non-ferromagnetic metallic particles;

(g) channeling the fraction of dielectric particles comprising plastic to a mixing ejector, mixing the fraction of dielectric particles comprising plastic with pressurized transporting air at a pressure above atmospheric pressure, passing the fraction of dielectric particles comprising plastic through a cyclone to remove dust, and then through a screw feeder to a furnace of pyrolysis to obtain a pyrolysis gas, and passing the pressurized air containing dust particles from the cyclone to a scrubber, where irrigating water is used to remove the dust from the transporting pressurized air, passing the remaining dielectric particles through a slag cooler to cool the dielectric particles, and through a cyclone to refine the dielectric particles, to recover a slag product useful for making concrete;

(h) channeling the fraction of particles comprising both dielectric particles comprising plastic and electrically conductive non-ferromagnetic metallic particles to the mixing ejector, mixing the fraction of particles comprising both dielectric particles comprising plastic and electrically conductive non-ferromagnetic metallic particles with the pressurized transporting air at a pressure above atmospheric pressure, passing the fraction of dielectric particles comprising both dielectric particles comprising plastic and electrically conductive non-ferromagnetic metallic particles through a cyclone to remove dust, and then through the drum of the corona electrostatic drum separator according to step (f) to separate out the electrically conductive non-ferromagnetic metallic particles from the dielectric particles comprising plastic, passing the dielectric particles comprising plastic to the furnace of pyrolysis to obtain additional pyrolysis gas, and passing the pressurized air containing dust particles from the cyclone to the scrubber, where irrigating water is used to remove the dust from the transporting pressurized air passing the remaining dielectric particles through a slag cooler to cool the remaining dielectric particles, and through a cyclone to refine the remaining dielectric particles, to recover additional slag product useful for making concrete; and (i) combining the electrically conductive non-ferromagnetic metallic particles obtained according to steps (f) and (h) to recover non-ferromagnetic metals, which include platinum group metals, gold and silver, which may then be separated into the pure non-ferromagnetic metals.

4. The method of processing a solid waste material defined in claim 3 wherein according to step (f) the non-ferromagnetic particles of electronic, electric and cable scrap after drying to remove superficial humidity are warmed 2 to 4° C. above the temperature of the ambient air transporting the particles.

5. The method of processing a solid waste material defined in claim 3 wherein according to steps (f) and (h) the corona electrostatic separator provides a specific separation of the non-ferromagnetic particles into a dielectric fraction of particles and into electrically conductive non-ferromagnetic metallic particles as a result of corona discharges from the corona electrostatic separator, said discharges passing on a contact surface of the electrically conductive non-ferromagnetic metallic particles and destroying a bond between the non-ferromagnetic metallic particles and the dielectric particles on the surface.

6. The method of processing a solid waste material defined in claim 3 wherein according to steps (g) and (h) the optimal weight ratio of the dielectric fraction or the fraction of particles comprising both dielectric particles comprising plastic and electrically conductive non-ferromagnetic metallic particles to the required pressurized transporting air is 0.5 to 1.0 kg/kg of the pressurized air.

7. The method of processing a solid waste material defined in claim 3 wherein according to steps (g) and (h), the water, transported from the water treatment unit to the scrubber of air for removing dust is not chemically treated, but is physically treated to remove suspended solid substances.

8. The method of processing a solid waste material defined in claim 3 wherein according to steps (g) and (h), sufficient irrigating water is employed to remove the dust in the air separated from the fractions of dielectric particles in the cyclone so that relative humidity of the air leaving the scrubber is 100%.

9. The method of processing a solid waste material defined in claim 3, further comprising the step of (j) loading a mixture of ash and slag crushed to a size no greater than 5 mm from an electric power plant or heating plant into a lower end of an extractor whose chamber is upwardly inclined at an angle of 10 to 15°, loosening the mixture of ash and slag in the extractor through use of a rotating screw to increase its contact surface area, feeding water into the extractor at the upper end opposite the lower end through which the mixture of ash and crushed slag is loaded, to obtain a solution of heavy metals removed from the mixture of ash and crushed slag, centrifuging the obtained solution of heavy metals to separate out the heavy metals, and to obtain a filtrate, recovering the heavy metals separated from the mixture of ash and crushed slag, passing the mixture of ash and crushed slag from which the heavy metals have been removed to the furnace of pyrolysis to obtain pyrolysis gas and following the pyrolysis, passing the mixture of ash and crushed slag through the slag cooler to cool the mixture, through the cyclone to refine the mixture to recover additional slag product useful for making concrete.

* * * * *